US009917403B2

(12) United States Patent
Doi

(10) Patent No.: US 9,917,403 B2
(45) Date of Patent: Mar. 13, 2018

(54) CONNECTING STRUCTURE HAVING A REGULATING PORTION TO CONTROL DEFORMATION OF AN ELASTIC PORTION OF A TERMINAL IN AN ELECTRICAL CONNECTOR

(71) Applicant: HIROSE ELECTRIC CO., LTD., Tokyo (JP)

(72) Inventor: Kentaro Doi, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/594,871

(22) Filed: May 15, 2017

(65) Prior Publication Data

US 2017/0338592 A1 Nov. 23, 2017

(30) Foreign Application Priority Data

May 23, 2016 (IS) ..... 2016-102105

(51) Int. Cl.
*H01R 13/64* (2006.01)
*H01R 13/635* (2006.01)
(Continued)

(52) U.S. Cl.
CPC ..... *H01R 13/635* (2013.01); *H01R 12/7035* (2013.01); *H01R 13/18* (2013.01);
(Continued)

(58) Field of Classification Search
CPC ..... H01R 9/16; H01R 9/24; H01R 13/514; H01R 13/516; H01R 13/518;
(Continued)

(56) References Cited

U.S. PATENT DOCUMENTS 5,281,160 A * 1/1994 Walkup ..... H01R 12/89 439/266
7,722,409 B2 * 5/2010 Takamoto ..... A63F 13/02 439/575
(Continued)

FOREIGN PATENT DOCUMENTS

EP 2846409 A2 3/2015
JP 2014099361 A 5/2014
(Continued)

*Primary Examiner* — Chandrika Prasad
(74) *Attorney, Agent, or Firm* — Kubotera & Associates, LLC

(57) ABSTRACT

An electrical connector includes a housing formed of a fixed housing and a movable housing movable relative to the fixed housing. The connector further includes a terminal. The terminal includes a connecting portion to be connected to the electrical circuit board and a contact portion to be contacted with the mating connecting member. The terminal further includes a fixed side held portion, a movable side held portion, and an elastic portion. The connecting structure further includes a regulating portion for regulating the elastic portion from elastically deforming within a specific elastic deformation range. The elastic portion is configured to have a specific elastic deformation range. When the electrical connector is connected to the mating connecting member, the spring force is smaller than a holding force between the contact portion of the terminal and the mating connecting member in a direction that the electrical connector is pulled out.

4 Claims, 8 Drawing Sheets

(51) Int. Cl.

| | |
|---|---|
| ***H01R 13/18*** | (2006.01) |
| ***H01R 12/70*** | (2011.01) |
| ***H01R 13/631*** | (2006.01) |
| *H01R 13/508* | (2006.01) |
| *H01R 13/02* | (2006.01) |
| *H01R 13/62* | (2006.01) |

(52) U.S. Cl.
CPC ..... *H01R 13/6315* (2013.01); *H01R 12/7005* (2013.01); *H01R 12/707* (2013.01); *H01R 12/7058* (2013.01); *H01R 13/02* (2013.01); *H01R 13/508* (2013.01); *H01R 13/62* (2013.01)

(58) Field of Classification Search
CPC ..... H01R 13/627; H01R 13/4223; H01R 13/4226; H01R 13/4362; H01R 13/6271; H01R 13/6275
USPC ..... 439/620.15, 247, 248
See application file for complete search history.

(56) References Cited

U.S. PATENT DOCUMENTS

| | | | | |
|---|---|---|---|---|
| 9,033,743 | B2 * | 5/2015 | Kobayashi | H01R 13/11 439/637 |
| 9,065,228 | B2 * | 6/2015 | Nishimura | H01R 12/79 |
| 9,698,508 | B2 * | 7/2017 | Kobayashi | H01R 13/187 |
| 2005/0037641 | A1 * | 2/2005 | Chen | H01R 13/112 439/71 |
| 2014/0134890 | A1 | 5/2014 | Kobayashi et al. | |
| 2016/0294089 | A1 | 10/2016 | Kobayashi et al. | |
| 2016/0294111 | A1 | 10/2016 | Kobayashi et al. | |
| 2017/0033480 | A1 | 2/2017 | Sato | |

FOREIGN PATENT DOCUMENTS

| | | | |
|---|---|---|---|
| JP | 5849166 | B1 | 1/2016 |
| WO | 2004062041 | A1 | 7/2004 |
| WO | 2015-199071 | A1 | 12/2015 |

* cited by examiner

CONNECTING STRUCTURE HAVING A REGULATING PORTION TO CONTROL DEFORMATION OF AN ELASTIC PORTION OF A TERMINAL IN AN ELECTRICAL CONNECTOR

BACKGROUND OF THE INVENTION AND RELATED ART STATEMENT

The present invention relates to a connecting structure between an electrical connector and a mating connecting member. More specifically, the present invention relates to a connecting structure for electrically connecting an electrical connector to be mounted on an electrical circuit board and a mating connecting member to be connected to the electrical connector in a direction perpendicular to a mounting surface of the electrical circuit board.

Patent Reference has disclosed a conventional connecting structure of a connector. In the conventional connecting structure disclosed in Patent Reference, the connector includes a housing formed of a fixed housing to be fixed to an electrical circuit board and a movable housing configured to be movable relative to the fixed housing. The connector further includes terminals held with the housing, so that the terminals bridge between the fixed housing and the movable housing.

Patent Reference: Japanese Patent Publication No. 2014-099361

In the conventional connecting structure disclosed in Patent Reference, the connector includes the fixed housing to be mounted on a surface of the electrical circuit board, and the fixed housing is formed in a rectangular frame shape so that a central portion of the rectangular frame shape is opened as an inside structure thereof to penetrate in a vertical direction. The movable housing is situated in the central portion of the fixed housing, so that a space is created around the movable housing between the movable housing and the fixed housing. The movable housing includes a hollow portion opened upwardly, so that a mating side connector is fitted into the hollow portion as a mating connecting member from above.

Further, in the conventional connecting structure disclosed in Patent Reference, the terminal includes on one end portion thereof an elastic piece situated in the hollow portion of the movable housing. The elastic piece includes a contact portion for contacting with a mating side terminal of the mating side connector. Further, the terminal includes on the other end portion thereof a board connecting portion to be connected to the electrical circuit board. The board connecting portion is arranged to extend outside the fixed housing. When the mating side connector is fitted into the movable housing, the contact portion contacts with the mating side terminal of the mating side connector.

As described above, in the conventional connecting structure disclosed in Patent Reference, the terminal includes the elastic piece on one end portion thereof. The elastic piece is arranged to extend to a bottom portion of the movable housing. A lower end portion of the elastic piece is bent to form an arm portion extending outside the movable housing. A fixed piece portion is disposed at a middle portion of the arm portion, so that the fixed piece is fixed into a hole portion of the movable housing.

As described above, in the conventional connecting structure disclosed in Patent Reference, the terminal includes the board connecting portion on the other end portion thereof. The board connecting portion is connected to the arm portion situated at the bottom portion of the fixed housing.

A fixed piece portion is disposed at the middle portion of the arm portion, so that the fixed piece is fixed into a hole portion of the fixed housing.

In the conventional connecting structure disclosed in Patent Reference, the terminal further includes a movable portion between the arm portion on the side of the movable housing and the arm portion on the side of the fixed housing. The movable portion is formed in an open loop shape standing from the bottom portion, so that the movable portion is capable of elastically deforming. The movable portion has base portions connected to the arm portion on the side of the movable housing and the arm portion on the side of the fixed housing.

In the conventional connecting structure disclosed in Patent Reference, the movable portion is formed in an open loop shape, and has the base portions arranged close to each other. Accordingly, the movable portion has an entire shape close to a circular shape, so that the movable portion is capable of elastically deforming to a large extent. Further, the movable portion is disposed in a space between the fixed housing and the movable housing. Accordingly, when the movable portion deforms elastically, the movable housing is capable of moving in any direction of an orthogonal coordinate axis in the space, thereby making so-called floating possible.

In the conventional connecting structure disclosed in Patent Reference, when the mating side connector is connected to the connector at a position shifted from a normal position or in a posture shifted from a normal posture, the movable portion of the terminal of the connector elastically deformed. Accordingly, the movable housing moves to follow the mating side connector, and it is possible to maintain the terminal in the contact state with the mating side terminal.

Further, in the conventional connecting structure disclosed in Patent Reference, when the mating side connector is connected to the connector in use, the connector may receive an external vibration. Even when the connector receives an external vibration, the movable portion of the terminal of the connector is elastically deformed, so that the movable housing moves to follow the mating side connector. However, when the connector receives an external vibration, the terminal may also be shifted (vibrated) relative to the mating side terminal accompanied with friction due to a spring force exerted from the movable portion that is elastically deformed. If the terminal is shifted (vibrated) relative to the mating side terminal, the vibration may cause a negative effect on the terminal or the mating terminal such as wear or damage. It should be noted that Patent Reference does not address the issue.

In view of the problems described above, an object of the present invention is to provide a connecting structure capable of solving the problems of the conventional connecting structure. In the connecting structure of the present invention between a connector to be mounted on an electrical circuit board and a mating connecting member, it is possible to prevent friction and relative movement between a terminal and a mating side terminal even when the connector receive an external force.

Further objects and advantages of the invention will be apparent from the following description of the invention.

SUMMARY OF THE INVENTION

In order to attain the objects described above, according to a first aspect of the present invention, a connecting structure is configured to connect an electrical connector to be mounted on an electrical circuit board and a mating connecting member. More specifically, the connecting structure is configured to electrically connect an electrical connector to be mounted on an electrical circuit board and a mating connecting member to be connected to the electrical connector in a direction perpendicular to a mounting surface of the electrical circuit board.

According to the first aspect of the present invention, in the connecting structure, the electrical connector includes a housing formed of a fixed housing to be fixed to the electrical circuit board and a movable housing configured to be movable relative to the fixed housing. The connector further includes a terminal held with the housing, so that the terminal bridges between the fixed housing and the movable housing. The terminal includes a connecting portion to be connected to the electrical circuit board on one end portion thereof and a contact portion to be contacted with the mating connecting member on the other end portion thereof. Further, the mating connecting member is fitted into the movable housing.

According to the first aspect of the present invention, in the connecting structure, the terminal further includes a fixed side held portion, a movable side held portion, and an elastic portion. The fixed side held portion is held with the fixed housing, and the movable side held portion is held with the movable housing. The elastic portion is arranged to connect the fixed side held portion and the movable side held portion, and is configured to be capable of elastically deforming.

According to the first aspect of the present invention, the connecting structure further includes a regulating portion disposed on the fixed housing and the movable housing for regulating the elastic portion from elastically deforming within a specific elastic deformation range in a direction that the electrical connector is fitted. Further, the elastic portion is configured to have a specific spring force when the elastic portion is elastically deformed to a maximum elastic deformation amount within the specific elastic deformation range. When the electrical connector is connected to the mating connecting member, the spring force is smaller than a holding force between the contact portion of the terminal and the mating connecting member in a direction that the electrical connector is pulled out.

As described above, according to the first aspect of the present invention, in the connecting structure, it is configured such that the spring force of the elastic portion of the terminal is smaller than the holding force between the contact portion of the terminal and the mating connecting member. Accordingly, in the state that the electrical connector is connected to the mating connecting member, when the electrical connector receives a vibration in the connector fitting direction within the elastic deformation range regulated with the regulating portion, the terminal is not shifted relative to the mating connecting member even when the terminal receives the spring force at the contact portion thereof. Accordingly, it is possible to maintain the contact portion at a normal position. In other words, the contact portion of the terminal is not moved from the mating connecting member whiling causing friction. It should be noted that when the electrical connector is pulled out, the mating connecting member may be pulled out with a force greater than the spring force regulated with the regulating portion.

According to a second aspect of the present invention, in the connecting structure according to the first aspect, the regulating portion may includes a first regulating portion for setting one limit of the elastic deformation range of the elastic portion in the connector fitting direction and a second regulating portion for setting the other limit of the elastic deformation range of the elastic portion in the connector fitting direction.

According to a third aspect of the present invention, in the connecting structure according to the second aspect, the first regulating portion may include the fixed housing or a first fixed side member, and the movable housing or a first movable side member. The first fixed side member is attached to the fixed housing, and the first movable side member is attached to the movable housing. When the elastic portion elastically deforms in the connector pulling out direction, the fixed housing or the first fixed side member abuts against the movable housing or the first movable side member. Accordingly, the first regulating portion sets the one limit of the elastic deformation range of the elastic portion in the connector pulling out direction.

According to a fourth aspect of the present invention, in the connecting structure according to the second aspect, the second regulating portion may include the movable housing or a second movable side member, and the fixed housing, a second fixed side member, or the electrical circuit board on which the fixed housing is mounted. The second fixed side member is attached to the fixed housing, and the second movable side member is attached to the movable housing. When the elastic portion elastically deforms in the connector fitting direction, the movable housing or the second movable side member abuts against the fixed housing, the second fixed side member, or the electrical circuit board. Accordingly, the second regulating portion sets the other limit of the elastic deformation range of the elastic portion in the connector fitting direction.

As described above, according to the present invention, in the electrical connector to be mounted on the electrical circuit board, the terminal is disposed to bridge between the movable housing and the fixed housing. The terminal includes the elastic portion capable of floating. In the state that the movable housing is fitted into the mating connecting member, it is configured such that the spring force of the elastic portion of the terminal within the elastic deformation range is smaller than the holding force between the contact portion of the terminal and the mating connecting member. Accordingly, when the electrical connector receives an external vibration in the connector fitting direction, the terminal is not shifted relative to the mating connecting member even when the terminal receives the spring force at the contact portion thereof. As a result, it is possible to prevent wear of the terminal at the contact portion thereof due to friction.

BRIEF DESCRIPTION OF THE DRAWINGS

FIGS. 1(A) and 1(B) are perspective views showing a connector assembled member having a plug side connector (a first connector) and a receptacle side connector (a second connector) according to a first embodiment of the present invention, wherein FIG. 1(A) is a perspective view showing the connector assembled member before the plug side connector is connected to the receptacle side connector and FIG. 1(B) is a perspective view showing the connector assembled member after the plug side connector is connected to the receptacle side connector;

FIGS. 2(A) and 2(B) are sectional perspective views showing the connector assembled member having the plug side connector and the receptacle side connector according to the first embodiment of the present invention, wherein FIG. 2(A) is a sectional perspective view showing the connector assembled member before the plug side connector is connected to the receptacle side connector and FIG. 2(B) is a sectional perspective view showing the connector assembled member after the plug side connector is connected to the receptacle side connector;

FIGS. 3(A) and 3(B) are sectional perspective views showing the plug side connector of the connector assembled member according to the first embodiment of the present invention, wherein FIG. 3(A) is a partial sectional perspective view showing the plug side connector and FIG. 3(B) is a sectional perspective view showing the plug side connector;

FIGS. 4(A) and 4(B) are perspective views showing the receptacle side connector of the connector assembled member according to the first embodiment of the present invention, wherein FIG. 4(A) is a perspective view showing the receptacle side connector and FIG. 4(B) is a sectional perspective view showing the receptacle side connector;

FIGS. 6(A) and 6(B) are sectional views showing the connector assembled member in a state that a second regulating portion regulates a movable housing from moving in a connector fitting direction according to the first embodiment of the present invention, wherein FIG. 6(A) is a sectional view showing the connector assembled member at a position where a terminal is located and FIG. 6(B) is a sectional view showing the connector assembled member at a position where the second regulating member is located;

FIGS. 7(A) and 7(B) are sectional views showing the connector assembled member in a state that a first regulating portion regulates the movable housing from moving in the connector fitting direction according to the first embodiment of the present invention, wherein FIG. 7(A) is a sectional view showing the connector assembled member at a position where the terminal is located and FIG. 7(B) is a sectional view showing the connector assembled member at a position where the first regulating member is located.

DETAILED DESCRIPTION OF THE PREFERRED EMBODIMENTS

Figure 1:
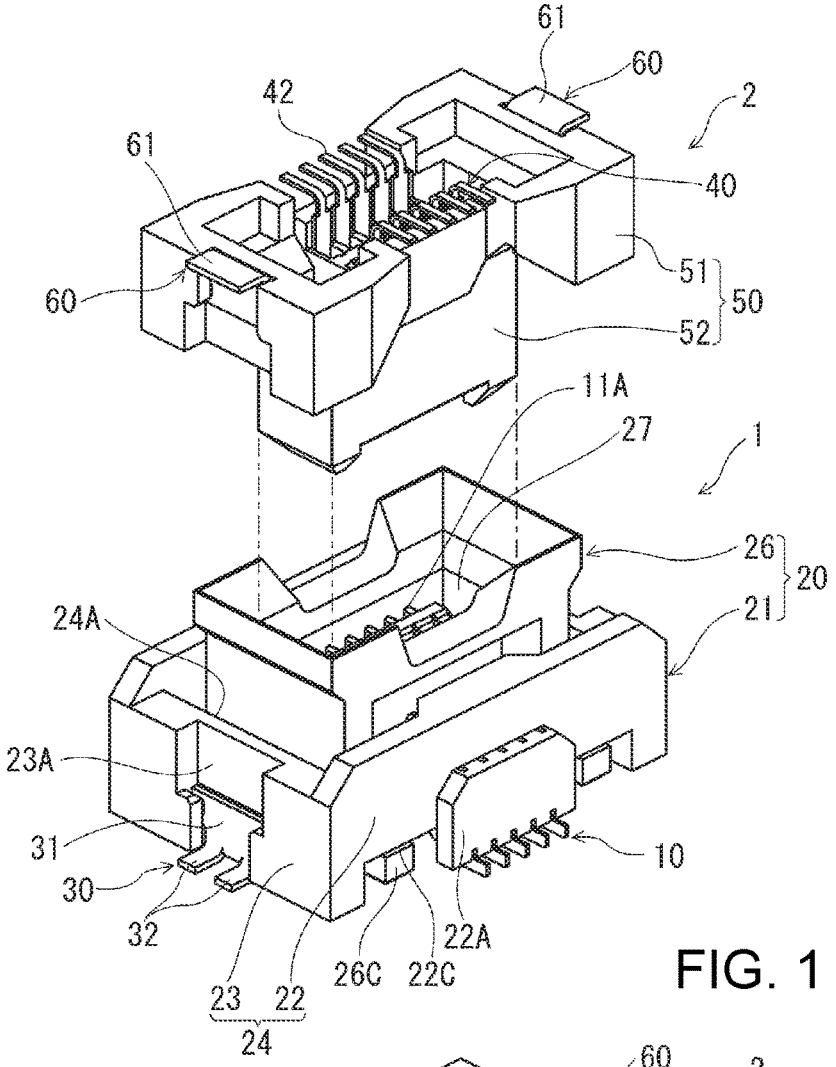
Figure 1:
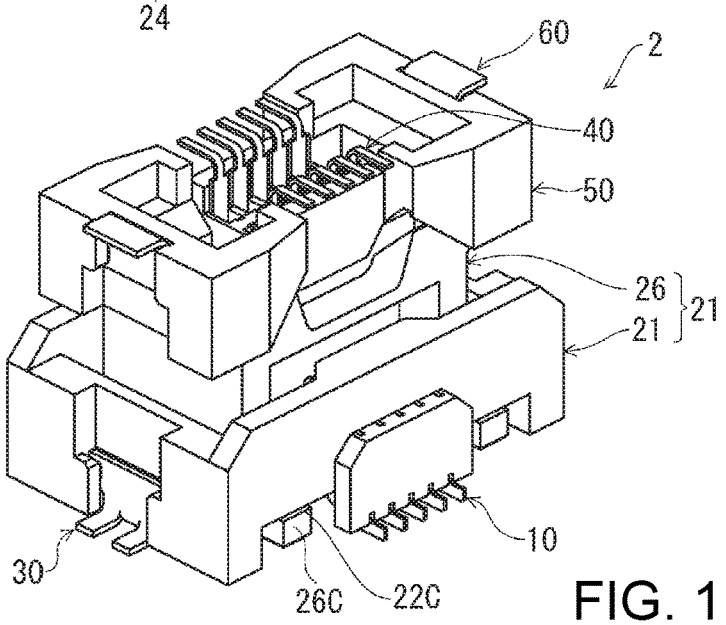

Hereunder, embodiments of the present invention will be explained with reference to the accompanying drawings. In the accompanying drawings, similar components are designated with the same reference numerals, and repeated explanations thereof are omitted.

First Embodiment

A first embodiment of the present invention will be explained. FIGS. 1(A) and 1(B) are perspective views showing a connector assembled member having a plug side connector 1 (a first connector 1) and a receptacle side connector 2 (a second connector 2) according to a first embodiment of the present invention. More specifically, FIG. 1(A) is a perspective view showing the connector assembled member before the plug side connector 1 is connected to the receptacle side connector 2, and FIG. 1(B) is a perspective view showing the connector assembled member after the plug side connector 1 is connected to the receptacle side connector 2. It should be noted that the plug side connector 1 includes a male type terminal, and the receptacle side connector 2 includes a female type terminal.

Figure 2:
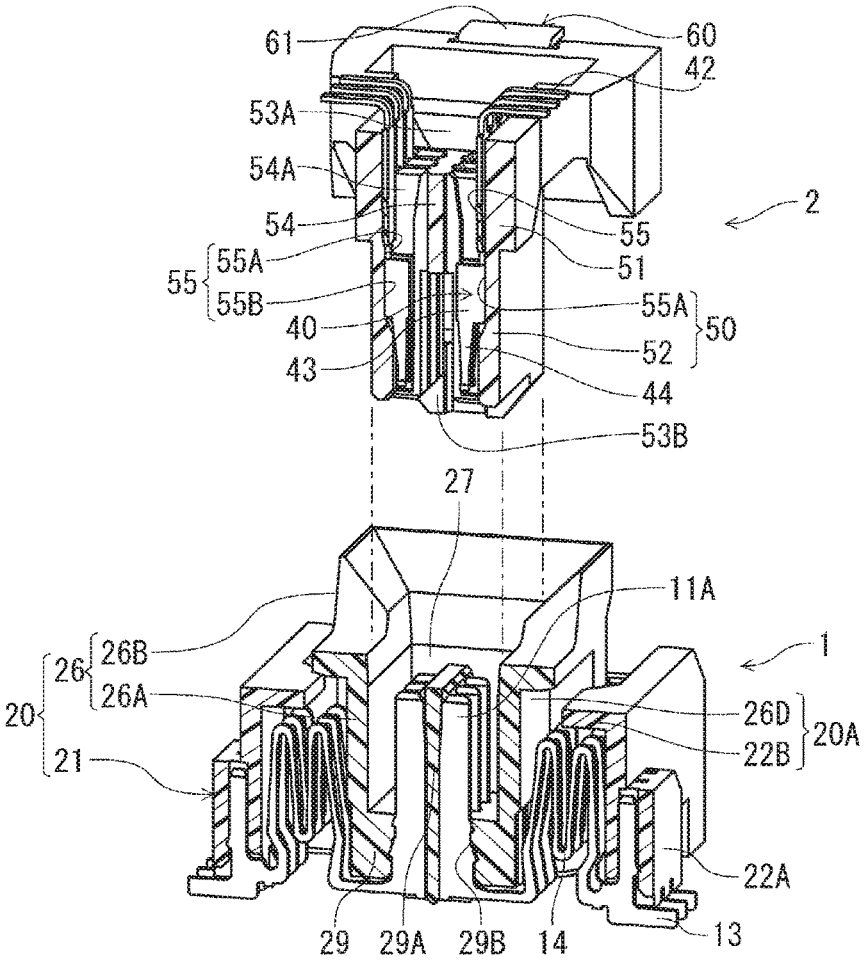
Figure 2:
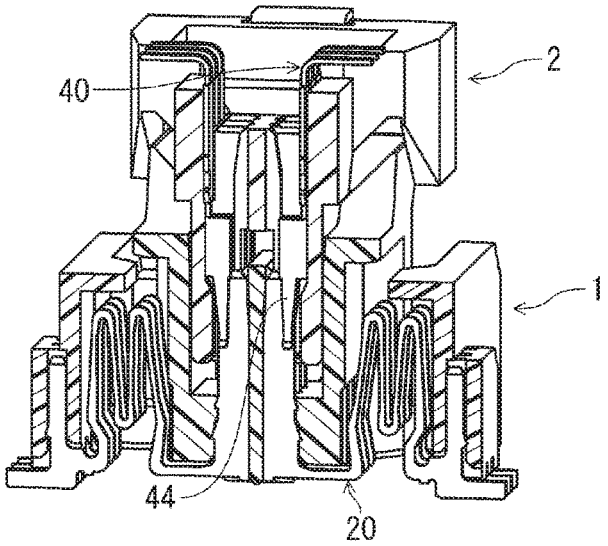

FIGS. 2(A) and 2(B) are sectional perspective views showing the connector assembled member having the plug side connector 1 and the receptacle side connector 2 according to the first embodiment of the present invention. More specifically, FIG. 2(A) is a sectional perspective view showing the connector assembled member before the plug side connector 1 is connected to the receptacle side connector 2 and FIG. 2(B) is a sectional perspective view showing the connector assembled member after the plug side connector 1 is connected to the receptacle side connector 2.

Figure 3:
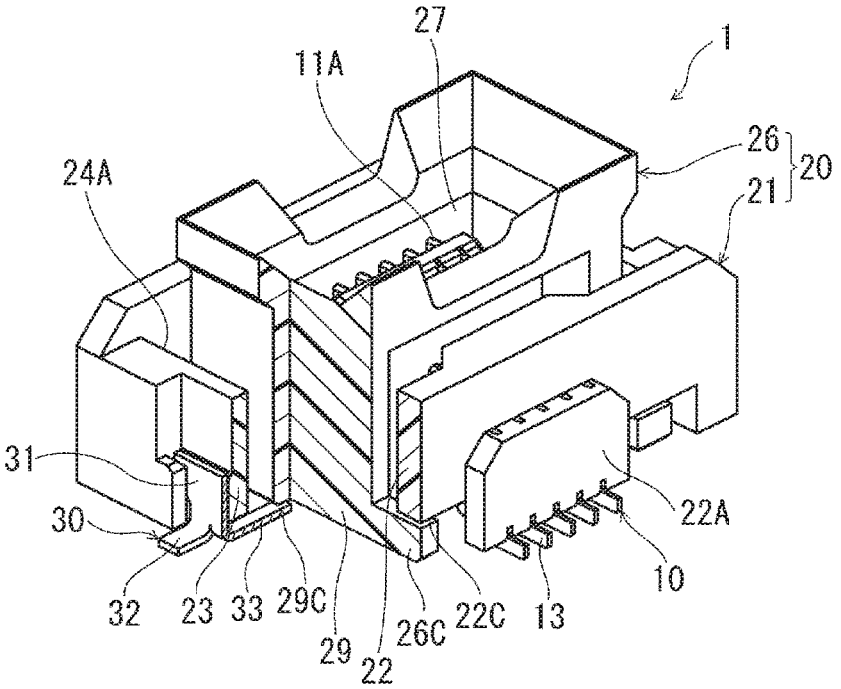
Figure 3:
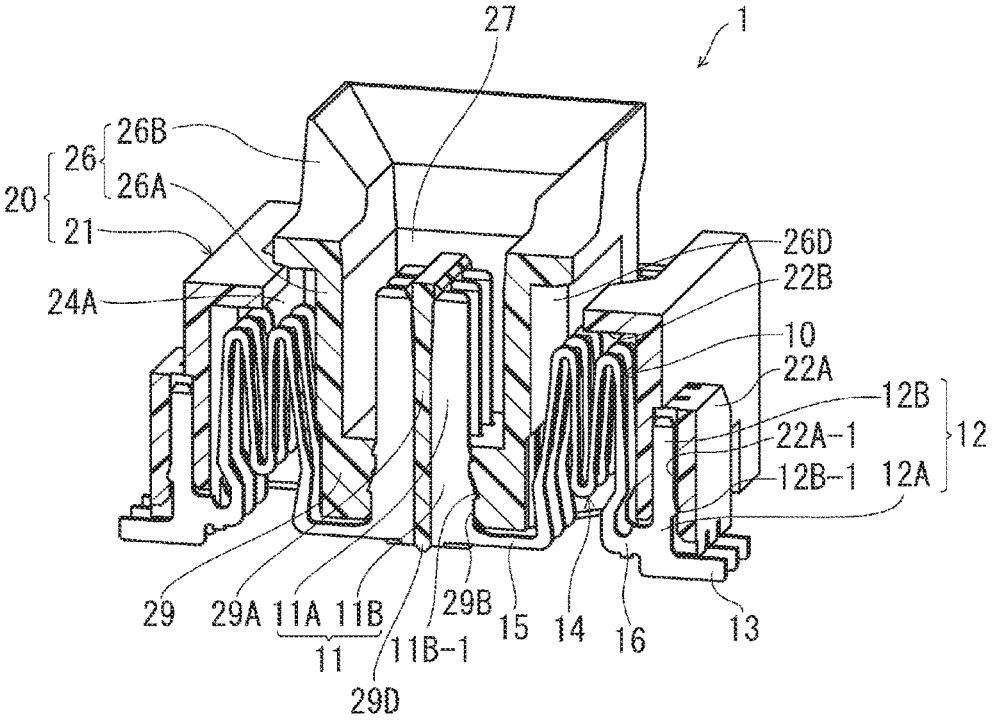

FIGS. 3(A) and 3(B) are sectional perspective views showing the plug side connector 1 of the connector assembled member according to the first embodiment of the present invention. More specifically, FIG. 3(A) is a partial sectional perspective view showing the plug side connector 1 and FIG. 3(B) is a sectional perspective view showing the plug side connector 1.

Figure 4:
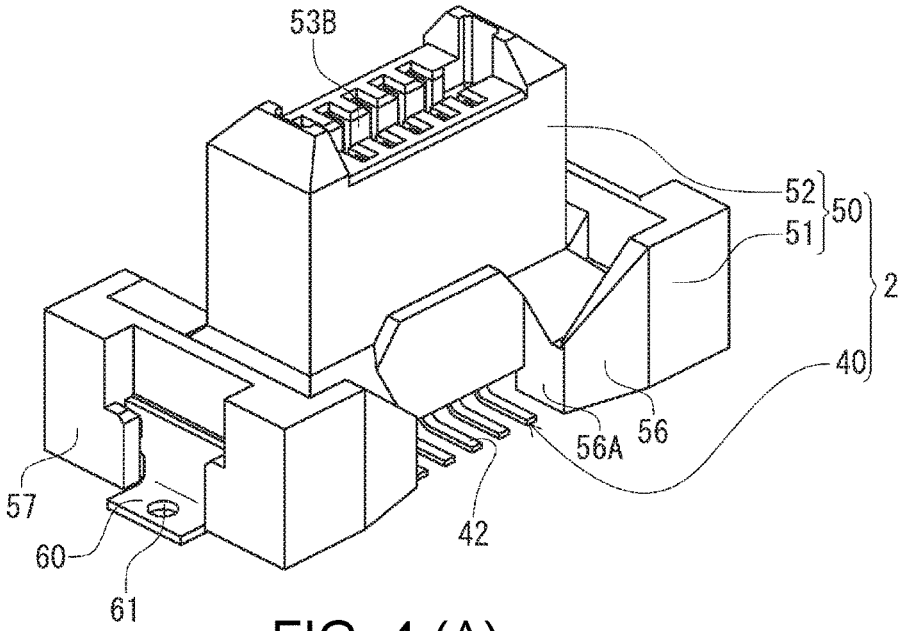
Figure 4:
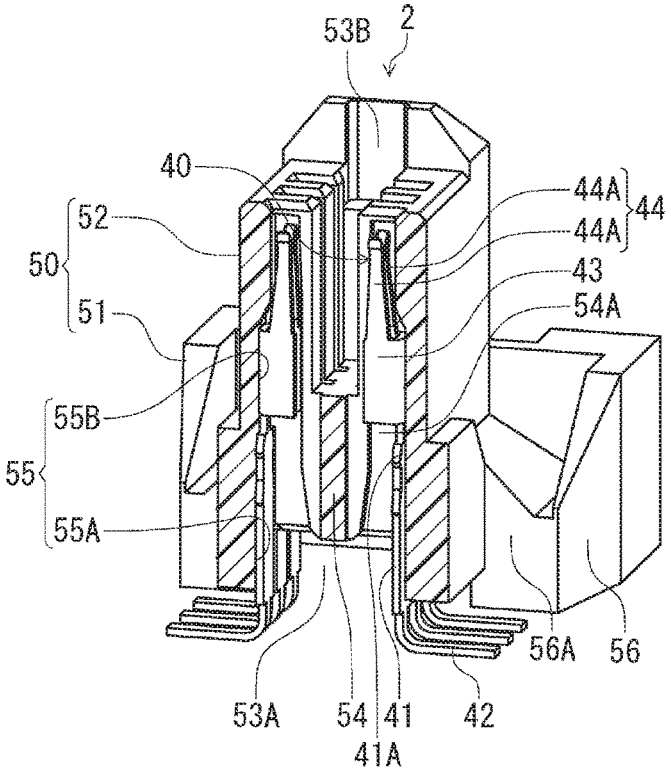

FIGS. 4(A) and 4(B) are perspective views showing the receptacle side connector 2 of the connector assembled member according to the first embodiment of the present invention. More specifically, FIG. 4(A) is a perspective view showing the receptacle side connector 2 and FIG. 4(B) is a sectional perspective view showing the receptacle side connector 2.

In the first embodiment, the first connector 1 includes first terminals 10 with the male type; a first housing 20 formed of an electrically insulation material for holding the first terminals 10; and an attachment metal member 30 held with the first housing 20. It should be noted that the terminals and the housing of the first connector 1 are designated with "first", and the terminals and the housing of the second connector 2 are designated with "second".

In the first embodiment, the first housing 20 includes a fixed housing 21 and a movable housing 26. The fixed housing 21 is configured to be attached to an electrical circuit board (not shown) through the first terminals 10. The movable housing 26 is configured to be movable relative to the fixed housing 21. In the first connector 1, the first housing 20 is formed in a substantially rectangular cubic shape extending in a longitudinal direction and a short side direction thereof along a plane parallel to the electrical circuit board. The first terminals 10 are arranged in two rows in the longitudinal direction of the first housing 20. Further, the first terminals 10 are arranged to face each other symmetrically in the short side direction (a connector width direction) perpendicular to the longitudinal direction.

In the first embodiment, the fixed housing 21 includes a side wall portion 22 standing vertically on the electrical circuit board and extending in the longitudinal direction. Further, the fixed housing 21 includes a side wall portion 23 extending in the short side direction, so that the side wall portion 22 and the side wall portion 23 form a surrounding wall portion 24. A central space 24A is formed inside the surrounding wall portion 24 to penetrate in the vertical direction, so that the movable housing 26 is accommodated in the central space 24A from above.

In the first embodiment, the side wall portion 22 includes protruding wall portions 22A on an outer wall surface thereof along with the longitudinal direction over a terminal arrangement range for holding the first housing 20. Further, the side wall portion 22 includes fixed side recess portions 22B on an inner wall surface thereof. The fixed side recess portions 22B are formed to open inwardly and downwardly, and constitute a part of accommodation space for accommodating an elastic portion of the first housing 20 (described later). The protruding wall portions 22A and the fixed side recess portions 22B will be explained in more detail later in accordance with the first terminals 10.

In the first embodiment, the side wall portion 22 of the fixed housing 21 has a lower surface situated above a lower surface of a bottom wall portion 29 except the protruding wall portions 22A. As shown in FIGS. 1(A) and 3(A), the lower surface of the side wall portion 22 at both end portions (portions situated outside the terminal arrangement range) in the connector longitudinal direction constitutes a regulating portion 22C. The regulating portion 22C is situated above a regulated protruding portion 26C of the movable housing 26 (described later). When the regulating portion 22C abuts against the regulated protruding portion 26C, the regulating portion 22C regulates the movable housing 26 from moving upwardly (in the connector pulling out direction) and the first terminals 10 from elastically deforming upwardly within a specific range.

In the first embodiment, the attachment metal member 30 is attached to an outer surface of the side wall portion 23 of the fixed housing 21. When an attachment piece 32 (described later) formed on the attachment metal member 30 is attached to the electrical circuit board, the fixed housing 21 is fixed to the electrical circuit board (not shown) through not only the first terminals 10 but also the attachment metal member 30.

In the first embodiment, the movable housing 26 is configured to be movable relative to the fixed housing 21 through the elastic deformation of an elastic portion 14 of the first terminal 10. As shown in FIG. 2(A), the movable housing 26 includes a penetrating portion 26A and a protruding portion 26B. The penetrating portion 26A is situated in the central space 24A of the fixed housing 21 to penetrate through the central space 24A. The protruding portion 26B is formed to protrude upwardly from the central space 24A.

In the first embodiment, the movable housing 26 further includes a receiving recessed portion 27 in a range from the protruding portion 26B to the penetrating portion 26A. The receiving recessed portion 27 is formed to open upwardly for accommodating the second connector 2 as the mating connecting member or a mating connector. A central protruding wall portion 29A is disposed in the receiving recessed portion 27 to stand from the bottom wall portion 29 of the movable housing 26 for holding the first terminal 10. Further, a movable side recessed portion 26D is formed in an outer surface of the penetrating portion 26A of the movable housing 26. The movable side recessed portion 26D is formed to open downwardly and face the fixed side recess portion 22B of the fixed housing 21.

In the first embodiment, together with the fixed side recess portion 22B, the movable side recessed portion 26D constitutes an accommodating space 20A for accommodating the elastic portion 14 of the first terminal 10. More specifically, the central protruding wall portion 29A of the movable housing 26 is provided for holding the first terminal 10. It should be noted that it is not necessary to provide the central protruding wall portion 29A. Alternatively, instead of providing the central protruding wall portion 29A, it may be configured such that only a movable side column portion 11 of the first terminal 10 (described later) stands in the receiving recessed portion 27.

As shown in FIG. 3(A), the movable housing 26 further includes the regulated protruding portion 26C (refer to FIG. 1(A) as well). The regulated protruding portion 26C is formed in a rectangular column shape and extends outwardly in the connector width direction from a lower end portion of the movable housing 26 at both end portions thereof in the connector longitudinal direction (outside the terminal arrangement range). The regulated protruding portion 26C extends up to a range of the side wall portion 22 of the fixed housing 21 in the connector width direction. Further, the regulated protruding portion 26C includes a distal end portion situated below a flat lower surface of an end portion of the side wall portion 22 (corresponding to the regulating portion 22C described above).

As shown in FIG. 1(A) and FIG. 3(B), when the elastic portion 14 of the first terminal 10 is in a free state, a flat upper surface of the regulated protruding portion 26C is situated away from the regulating portion 22C of the side wall portion 22 with a space in between. When the elastic portion 14 is elastically deformed and the movable housing 26 is moved upwardly, the regulated protruding portion 26C abuts against the regulating portion 22C of the side wall portion 22. Accordingly, the elastic portion 14 is restricted from being elastically deformed and the movable housing 26 is restricted from being moved within a specific range. In other words, the regulating portion 22C of the fixed housing 21 and the regulated protruding portion 26C of the movable housing 26 constitute a first regulating portion for restricting the first terminal 10 from being deformed upwardly within a specific range (a limit) when the regulating portion 22C of the fixed housing 21 abuts against the regulated protruding portion 26C of the movable housing 26.

In the first embodiment, the upper surface of the regulated protruding portion 26C and the regulating portion 22C are formed to have entirely flat surfaces, and the flat surfaces abut against each other. It should be noted that the upper surface of the regulated protruding portion 26C and the regulating portion 22C are not limited to have the flat surfaces. Alternatively, the upper surface of the regulated protruding portion 26C and the regulating portion 22C may include protruding portions, so that the protruding portions abut against each other.

As shown in FIG. 3(A), the movable housing 26 further includes a regulated portion 29C on a lower surface of the bottom wall portion 29 at both end portions in the connector longitudinal direction. The regulated portion 29C is situated right below a regulating piece 33 of the attachment metal member 30 (described later).

As shown in FIG. 3(A), when the elastic portion 14 of the first terminal 10 is in the free state, the regulated portion 29C is situated away from the regulating piece 33 with a space in between. When the elastic portion 14 is elastically deformed and the movable housing 26 is moved downwardly, the regulated portion 29C abuts against the regulating piece 33. Accordingly, the first terminal 10 is restricted from being elastically deformed and the movable housing 26 is restricted from being moved within a specific range.

As shown in FIG. 3(B), a lower protruding portion 29D is disposed on the lower surface of the bottom wall portion 29 of the movable housing 26. The lower protruding portion 29D is arranged to protrude downwardly at a central portion in the connector width direction, and to extend over an entire range of the terminal arrangement range in the connector longitudinal direction.

Figure 5:
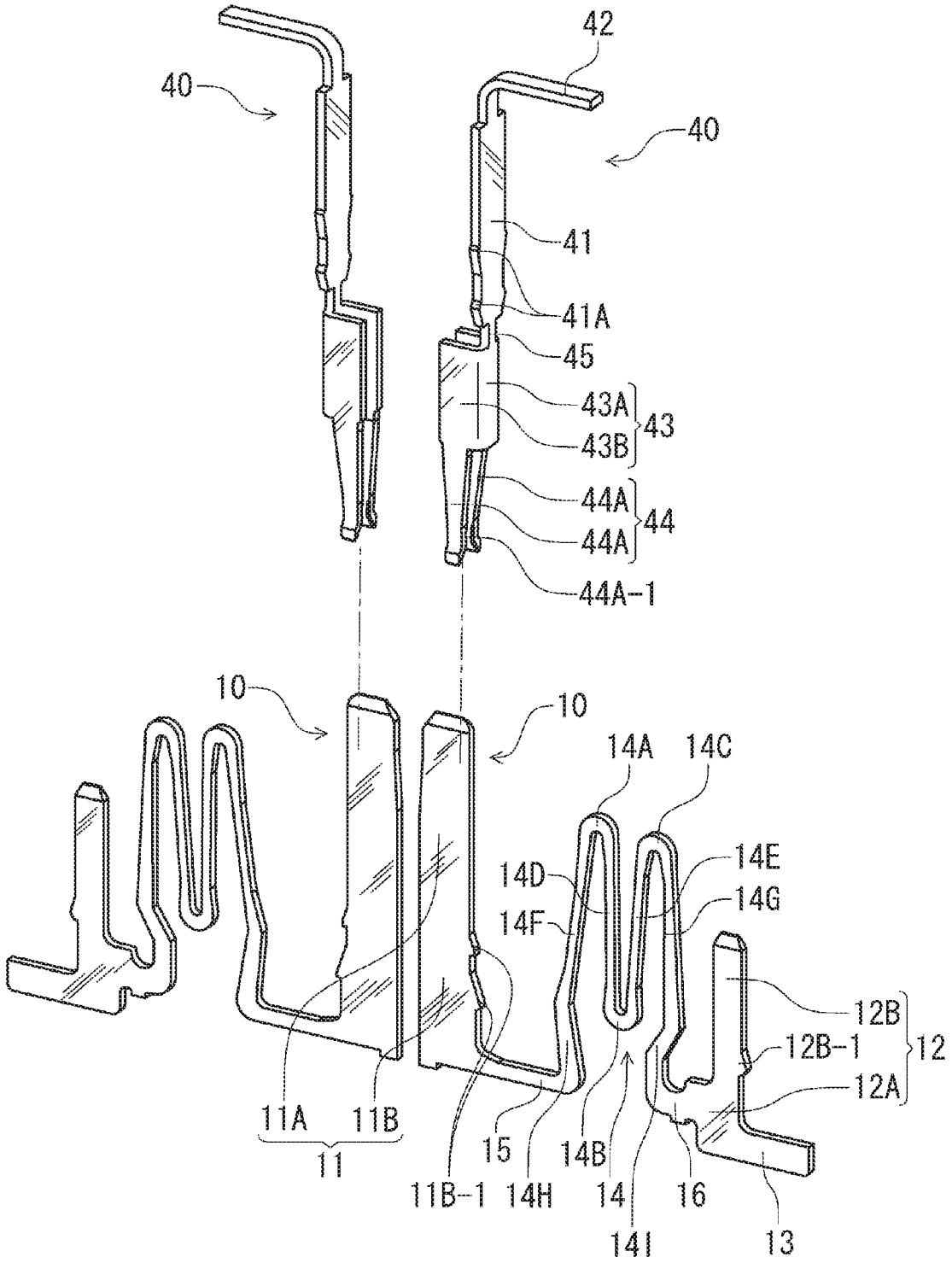
FIG. 5 is a perspective view showing a first terminal and a second terminal of the connector assembled member having the plug side connector and the receptacle side connector according to the first embodiment of the present invention.
Figure 6:
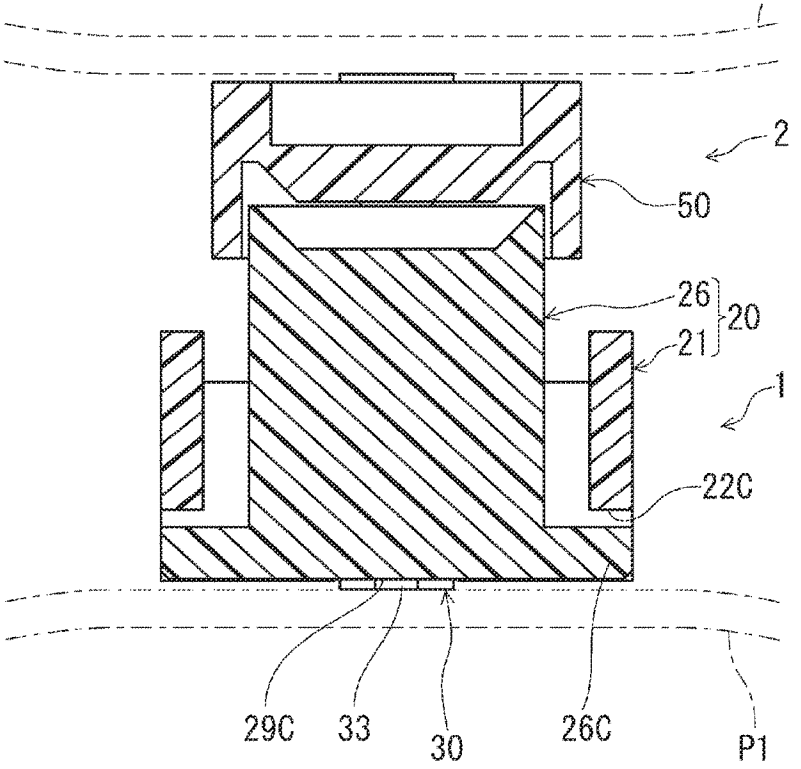
Figure 6:
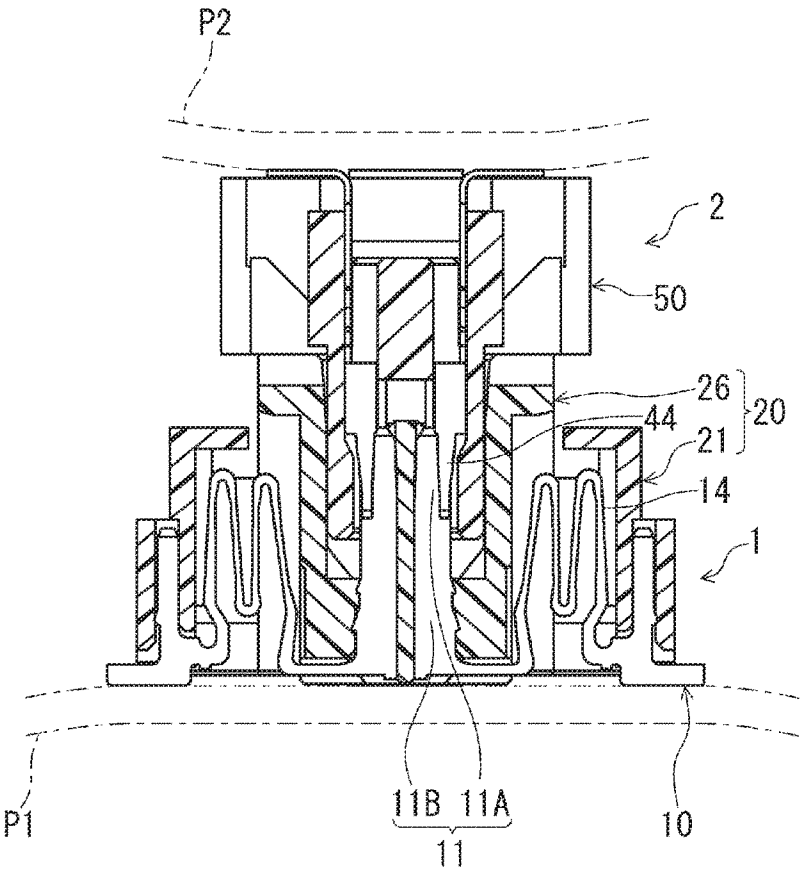
Figure 7:
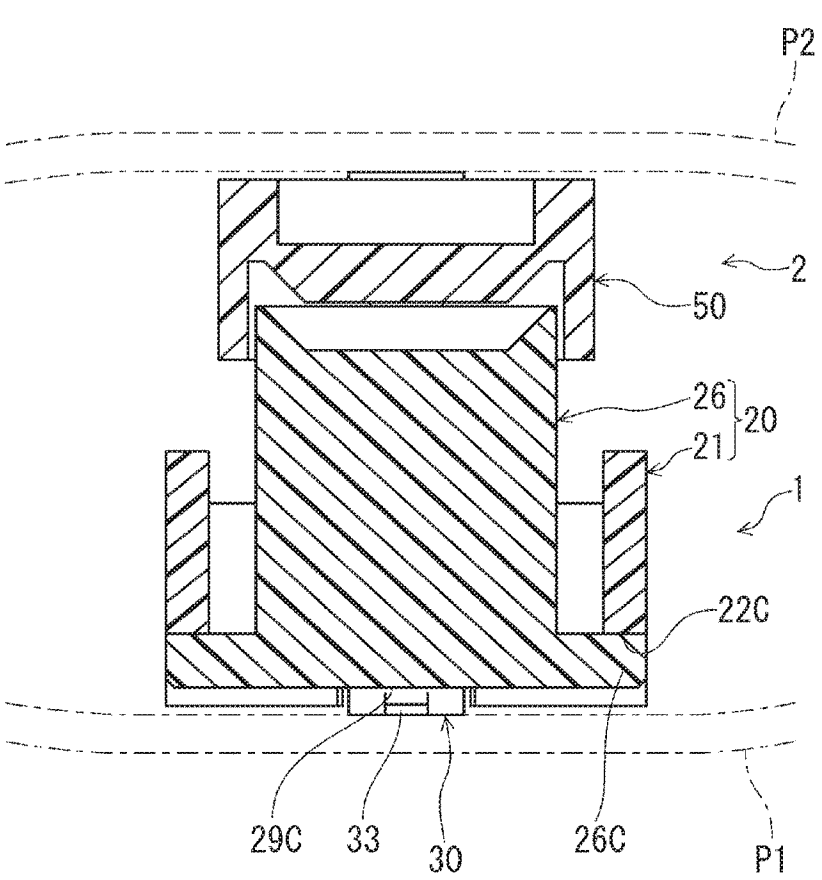
Figure 7:
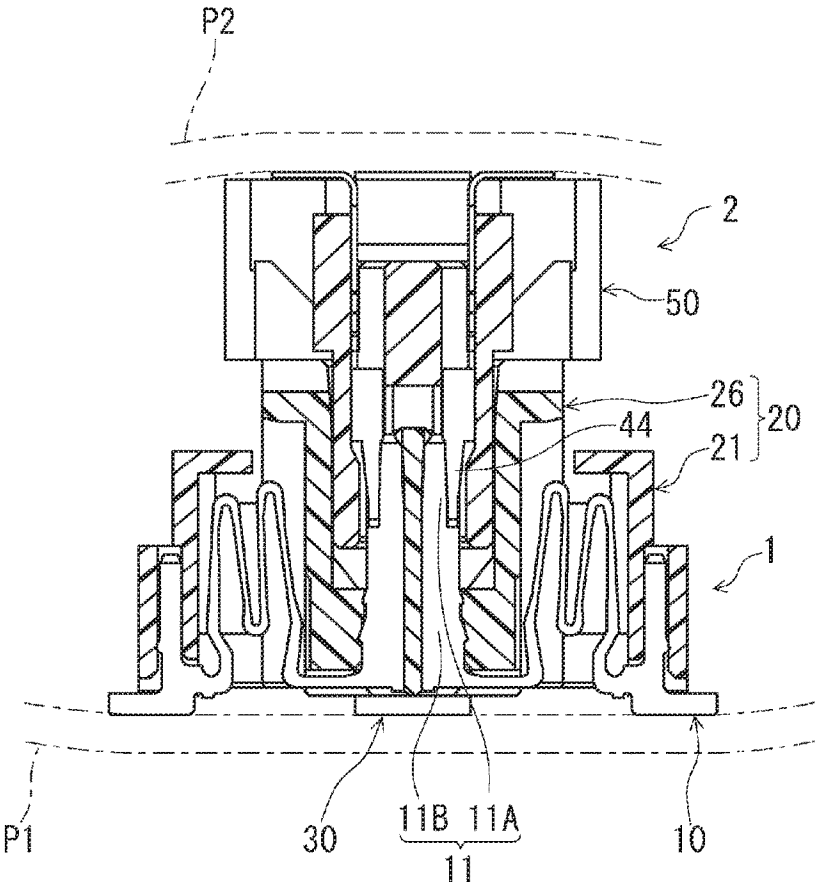

As shown in FIG. 5, the first terminal 10 is formed of a metal plate member having flat surfaces. The first terminals 10 have an identical shape and are arranged in a pair to face in the connector width direction, so that the first terminals 10 are symmetrical in the connector width direction. Further, the first terminals 10 are arranged in a plurality of rows in the connector longitudinal direction.

As shown in FIG. 5, one pair of the first terminals 10 is illustrated in a state that the first terminals 10 are pulled out from the first housing 20. Further, a pair of second terminals 40 of the second connector 2 to be connected to the first connector 1 as the mating connector is illustrated as well. As described above, the first terminals 10 arranged symmetrically have an identical shape, and one of the first terminals 10 (situated on the right side in FIG. 5) will be explained in more detail in the following description.

In the first embodiment, the first terminal 10 includes the movable side column portion 11; a fixed side column portion 12; a connecting portion 13; and the elastic portion 14. The movable side column portion 11 is disposed to stand at a position close to the second terminal 40 as the mating terminal facing in the connector width direction. Further, the movable housing 26 is configured to hold the movable side column portion 11. The fixed side column portion 12 is situated to stand at a position opposite to that of the movable side column portion 11 in the connector width direction. The connecting portion 13 is configured to extend from a lower edge of the fixed side column portion 12. The elastic portion 14 is situated between the movable side column portion 11 and the fixed side column portion 12. It should be noted that the movable side column portion 11, the fixed side column portion 12, the connecting portion 13, and the elastic portion 14 are integrated.

In the first embodiment, the movable side column portion 11 includes a contact portion 11A at an upper half portion thereof for contacting the second terminal 40 with the female type of the second connector 2. Further, the movable side column portion 11 includes a movable side held portion 11B at a lower portion thereof to be held with the movable housing 26. The contact portion 11A is chamfered at a distal end portion (an upper end portion) thereof, so that the first terminal 10 is easily inserted into the second terminal 40. The movable side held portion 11B includes an engaging protruding portion 11B-1 on a side edge portion thereof for engaging with the movable housing 26.

As shown in FIG. 3(B), a holing groove portion 29B is formed in the bottom wall portion 29 of the movable housing 26, so that the movable side held portion 11B is tightly fitted into the holding groove portion 29B from below. When the movable side held portion 11B is tightly fitted into the holding groove portion 29B from below, the engaging protruding portion 11B-1 bites a corresponding inner surface of the holding groove portion 29B, so that the engaging protruding portion 11B-1 tightly engages with the movable housing 26.

In the first embodiment, the fixed side column portion 12 includes a base portion 12A at a lower portion thereof and a fixed side held portion 12B at an upper portion thereof above the base portion 12A. The fixed side held portion 12B includes an engaging protruding portion 12B-1 for engaging with the fixed housing 21. A holing groove portion 22A-1 is formed in the protruding wall portion 22A protruding from the outer surface of the side wall portion 22 of the fixed housing 21 to penetrate in the vertical direction, so that the fixed side held portion 12B is tightly fitted into the holding groove portion 22A-1 from below. When the fixed side held portion 12B is tightly fitted into the holding groove portion 22A-1 from below, the engaging protruding portion 12B-1 bites a corresponding inner surface of the holding groove portion 22A-1, so that the engaging protruding portion 12B-1 tightly engages with the fixed housing 21.

In the first embodiment, the connecting portion 13 is disposed to extend from the lower end portion of the base portion 12A of the fixed side column portion 12. Further, the connecting portion 13 is disposed to extend in a lateral direction along the lower surface of the fixed housing 21 and outwardly outside the fixed housing 21.

As described above, in the first embodiment, the first terminal 10 includes the elastic portion 14 situated at a position between the movable side held portion 11B and the fixed side held portion 12B. The elastic portion 14 extends in the left direction such that the elastic portion 14 is connected to the movable side held portion 11B through a movable side transition portion 15 extending in the lateral direction from the lower end portion of the movable side held portion 11B. Further, the elastic portion 14 extends in the right direction such that the elastic portion 14 is connected to the fixed side held portion 12B through a fixed side transition portion 16 extending in the lateral direction from the base portion 12A below the fixed side held portion 12B.

In the first embodiment, the elastic portion 14 is formed of one single band member with a substantially M character shape rising from the movable side transition portion 15 and the fixed side transition portion 16. More specifically, the elastic portion 14 is formed of one single band member with a substantially M character shape having a width smaller than that of the movable side held portion 11B and the fixed side held portion 12B.

In the first embodiment, the elastic portion 14 includes two bent portions 14 and 14C having a curved shape at an upper portion thereof and one bent portion 14B having a curved shape at a lower portion thereof. Further, the elastic portion 14 includes an inner side straight portion 14D connecting the bent portion 14A and the bent portion 14B; an inner side straight portion 14E connecting the bent portion 14C and the bent portion 14B; and outer side straight portions 14E and 14G extending from the bent portion 14A and the bent portion 14C, respectively.

As described above, in the first embodiment, the elastic portion 14 is formed in the substantially M character shape, that is, a continuous wave shape formed of three wave shape portions, in which one wave shape portion with a U character shape is disposed between two wave shape portions with an inverted U character shape. Accordingly, the elastic portion 14 is capable of elastically deforming. It should be noted that each of the three wave shape portions has the bent portion and the straight portion. Further, in the three wave shape portions, each of the straight portions 14D, 14E, 14F, and 14G forms a widening portion inclined such that an opening width of the wave shape is increasing away from each of the bent portions 14A, 14B, and 14C, respectively.

In the first embodiment, among the three wave shape portions, the wave shape portion situated on the left side includes an inclined portion 14H. The inclined portion 14H is arranged to extend downwardly from the outer side straight portion 14F, and is inclined outwardly and inwardly (the right side in FIG. 5) at a lower portion thereof below the bent portion 14B in the vertical direction. Further, the wave shape portion situated on the right side includes an inclined portion 14I. The inclined portion 14H is arranged to extend downwardly from the outer side straight portion 14G, and is inclined outwardly and inwardly (the left side in FIG. 5) at a lower portion thereof below the bent portion 14B in the vertical direction. The inclined portion 14H and the inclined portion 14I are inclined downwardly and inwardly, so that a distance between the inclined portion 14H and the inclined portion 14I is decreased in the lower range below the bent portion 14B at the lower portion.

As described above, the elastic portion 14 is formed of the narrow width band member having the wave shape, so that the elastic portion 14 is capable of elastically deforming.

Further, each of the straight portions 14D, 14E, 14F, and 14G has the terminal width (the band width) gradually decreasing toward the center portion thereof to be narrower than the bent portions 14A and 14C. Further, each of the inner side straight portions 14D and 14E has the terminal width (the band width) gradually decreasing toward the center portion thereof to be narrower than the bent portion 14B.

Further, in the elastic portion 14, each of the outer side straight portions 14F and 14G has the terminal width (the band width) gradually decreasing toward the center portion thereof to be narrower than the inclined portions 14H and 14I. It should be noted that it is suffice that the elastic portion 14 has the terminal width (the band width) gradually decreasing, and the center portion thereof is not limited to a specific location. With the configuration described above, the elastic portion 14 is capable of elastically deforming easily with the bent portions 14A, 14B, and 14C as a pivot.

As described above, in the first embodiment, the first terminal 10 is formed of the metal plate member having the flat surface. Alternatively, the first terminal 10 may be formed of a metal plate member bent in a plate thickness direction thereof. When the first terminal 10 is formed of the metal plate member bent in the plate thickness direction thereof, the movable side column portion 11 includes plate surfaces crossing each other in the connector width direction, and the contact portion 11A is disposed on the plate surface.

In the configuration described above, when the movable housing 26 includes the central protruding wall portion 29A as in the first embodiment, the contact portion 11A is disposed on one of the plate surfaces that faces outwardly in the connector width direction, so that the contact portion 11A elastically contacts with the second terminal 40 of the second connector 2 as the mating connector.

Further in the configuration described above, when the movable housing 26 does not include the central protruding wall portion 29A as in the first embodiment, the contact portion 11A may be disposed on one or both of the plate surfaces of the movable side column portion 11. When the contact portion 11A is disposed on both of the plate surfaces of the movable side column portion 11, the movable side column portion 11 is elastically sandwiched with the second terminals 40 of the second connector 2 at the location of the contact portion 11A.

As shown in FIG. 1(A), the attachment metal member 30 is formed of a metal plate member bent in a plate thickness direction thereof. The attachment metal member 30 is tightly fitted into a holding recess portion 23A formed in the outer surface of the side wall portion 23 of the fixed housing 21. The attachment metal member 30 includes a held portion 31, the attachment pieces 32, and the regulating piece 33. The held portion 31 is arranged to extend in the vertical direction along the side wall portion 23, and is held in the holding recess portion 23A. The attachment pieces 32 are arranged to extend outwardly in the connector longitudinal direction at both end portions of lower edge portion of the held portion 31 in the connector width direction. The regulating piece 33 is arranged to extend inwardly in the connector longitudinal direction from the lower edge portion of the held portion 31 at the central portion in the connector width direction.

As shown in FIG. 3(A), the attachment piece 32 is arranged to extend outside the fixed housing 21, so that the attachment piece 32 is to be tightly fixed to the electrical circuit board with solder. The regulating piece 33 is arranged to extend inwardly in the connector longitudinal direction up to a location within a range of the movable housing 26. A distal end portion of the regulating piece 33 is situated just below the regulated portion 29C of the movable housing 26, so that the distal end portion of the regulating piece 33 can abut against the regulated portion 29C (described later). Accordingly, the regulating piece 33 restricts the movable housing 26 from moving downwardly within a specific distance. In other words, the regulating piece 33 of the attachment metal member 30 and the regulated portion 29C of the movable housing 26 constitute a second regulating portion for restricting the first terminal 10 from elastically deforming within a specific elastic deformation range when the regulating piece 33 of the attachment metal member 30 abuts against the regulated portion 29C of the movable housing 26. It should be noted that the regulating piece 33 may be configured such that the regulating piece 33 can be fixed to the electrical circuit board with solder.

In the first embodiment, the regulated portion 29C and the regulating piece 33 are formed to have entirely flat surfaces, and the flat surfaces abut against each other. It should be noted that the regulated portion 29C and the regulating piece 33 are not limited to have the flat surfaces. Alternatively, the upper surface of the regulated portion 29C and the regulating piece 33 may include protruding portions, so that the protruding portions abut against each other.

As described above, in the first embodiment, it is configured such that the first terminal 10 is restricted from elastically deforming within the elastic deformation range in the vertical direction between the upper limit and the lower limit. The first regulating portion (the side wall portion 22 of the fixed housing 21 and the regulated protruding portion 26C of the movable housing 26) defines the upper limit, and the second regulating portion (the regulating piece 33 of the attachment metal member 30 and the regulated portion 29C of the movable housing 26).

In the first embodiment, the elastic deformation range of the first terminal 10 in the vertical direction is set such that a spring force of the elastic portion 14 within the elastic deformation range becomes smaller than a holding force between the contact portion 11A of the first terminal 10 and a contact portion 44A of the second terminal 40 of the second connector 2 (described later) through friction in between in the connector pulling out direction when the first connector 1 is connected to the second connector 2. In other words, within the elastic deformation range, it is configured such that the spring force of the elastic portion 14 at a maximum deformation amount (referred to as a maximum spring force) becomes smaller than the holding force.

As shown in FIGS. 1(A)-1(B), 2(A)-2(B), and 4(A)-4(B), the second connector 2 includes the second terminals 40 with the female type; a second housing 50 formed of an electrically insulation material for holding the second terminals 40; and an attachment metal member 60 held with the second housing 50. The second housing 50 is fixed to an electrical circuit board (not shown) through the second terminals 40. The second housing 50 is formed in a substantially rectangular cubic shape such that a longitudinal direction and a short side direction thereof are aligned with the longitudinal direction and the short side direction of the first housing 20 of the first connector 1. The second terminals 40 are arranged in two rows in the longitudinal direction of the second housing 50. Further, the second terminals 40 are arranged to face each other in the short side direction (the connector width direction) perpendicular to the longitudinal direction. It should be noted that in FIGS. 1(A)-1(B) and 2(A)-2(B), the second connector 2 is illustrated such that the second connector 2 faces the first connector 1 in the connector connecting direction, and in FIGS. 4(A)-4(B), only the second connector 2 is illustrated such that the second connector 2 is inverted in the vertical direction.

In the first embodiment, the second housing 50 of the second connector 2 as the mating connector of the first connector 1 includes an attachment block portion 51 and a fitting block portion 52. The attachment block portion 51 is configured to be attached to the electrical circuit board (not shown). The fitting block portion 52 is configured to protrude from the attachment block portion 51 in the connector connecting direction relative to the first connector 1. The attachment block portion 51 and the fitting block portion 52 formed in substantially rectangular cubic shapes such that a longitudinal direction and a short side direction thereof are aligned with the longitudinal direction and the short side direction of the first housing 20 of the first connector 1.

As shown in FIGS. 1(A)-1(B) and 2(A)-2(B), the second housing 50 includes an upper recessed portion 53A at an upper portion thereof and a lower recessed portion 53B at a lower portion thereof at a central portion of the attachment block portion 51 viewed from below. The lower recessed portion 53B has a width smaller than that of the upper recessed portion 53A and a depth greater than that of the upper recessed portion 53A. Further, the second housing 50 includes a central wall portion 54 at a location between the upper recessed portion 53A and the lower recessed portion 53B. Further, the second housing 50 includes a terminal groove portion 55 arranged to extend along inner surfaces of the upper recessed portion 53A and the lower recessed portion 53B, and to penetrate through the central wall portion 54. The second terminal 40 is tightly fitted into the terminal groove portion 55 (described later).

As shown in FIG. 4(A), the attachment block portion 51 includes a side wall portion 56 extending in the longitudinal direction thereof, and a recessed wall portion 56A is formed on an outer surface of the side wall portion 56 at a central portion thereof in the longitudinal direction. The recessed wall portion 56 is recessed in the short side direction. A connecting portion 42 of the second terminal 40 is situated in the recessed wall portion 56A (described later), so that the connecting portion 42 is easily fixed to the electrical circuit board with solder. It should be noted that, with the recessed wall portion 56A, it is also possible to visually confirm the connection of the connecting portion 42 to the electrical circuit board.

In the first embodiment, the second housing 50 further includes an edge wall portion 57. The attachment metal member 60 with an L character shape is disposed on an outer surface of the edge wall portion 57. The attachment metal member 60 includes an attachment piece 61 extending outwardly in the connector longitudinal direction, so that the second housing 50 is tightly fixed to the electrical circuit board with solder. It should be noted that it is not necessary to provide the attachment metal member 60 for attaching the second housing 50 to the electrical circuit board. When it is possible to securely attach the second terminals 40 to the electrical circuit board with solder, it is not necessary to provide the attachment metal member 60.

As shown in FIG. 5, which illustrates the state before the first connector 1 is connected to the second connector 2, the second terminal 40 as the female terminal is formed of a metal band member bent in a thickness direction thereof. Further, the second terminals 40 have an identical shape and are arranged in a pair to face in the connector width direction, so that the second terminals 40 are symmetrical in the connector width direction. Further, the second terminals 40 are arranged in a plurality of rows in the connector longitudinal direction.

As shown in FIG. 5, one pair of the second terminals 40 is illustrated in a state that the second terminals 10 are pulled out from the second housing 50. As described above, the second terminals 40 arranged symmetrically have an identical shape, and one of the second terminals 40 (situated on the right side in FIG. 5) will be explained in more detail in the following description.

In the first embodiment, the second terminal 40 includes a held portion 41 with a flat band shape; the connecting portion 42; an intermediate base portion 43; and a contact portion 44. The held portion 41 is situated at a center portion of the second terminal 40 and has a plate surface extending in a direction perpendicular to the plate surface of the first terminal 10. The connecting portion 42 is configured to bend in a direction perpendicular to the plate surface of the held portion 41 at an upper end side above the held portion 41. The intermediate base portion 43 is situated at an intermediate location below the held portion 41 and has a U character sectional shape. The contact portion 44 is formed of a pair of contact pieces 44A at a location below the intermediate base portion 43 and extending in a finger shape.

In the first embodiment, the held portion 41 is formed in the flat band shape. Further, the held portion 41 includes an engaging protruding portion 41A on both side edges thereof, so that the engaging protruding portion 41 bits in a corresponding surface of the terminal groove portion 55 of the second housing 50.

In the first embodiment, the intermediate base portion 43 is connected to the held portion 41 through a joining portion 45 having a narrow portion. Further, the intermediate base portion 43 includes a bottom surface portion 43A and a side surface portion 43B. The bottom surface portion 43A is arranged to extend a plate surface of the held portion 41, and is formed in a plate shape. The joining portion 43B is arranged to extend from both edge portions of the bottom surface portion 43A in a direction perpendicular to the plate surface of the bottom surface portion 43A. It should be noted that the bottom surface portion 43A and the side surface portion 43B on the both edge portions of the bottom surface portion 43A are arranged to form a U character shape.

As described above, in the first embodiment, the contact portion 44 is formed of a pair of contact pieces 44A. The contact pieces 44A are arranged to extend from a lower edge of the side surface portion 43B on both sides of the intermediate base portion 43 in a finger shape. Further, the contact pieces 44A are arranged to face each other. Further, the contact pieces 44A are inclined such that a distance between the contact pieces 44A is decreasing downwardly. Accordingly, the contact pieces 44A are arranged to approach to each other downwardly. The contact pieces 44A are arranged such that the distance between the contact pieces 44A becomes a minimum at lower end portions thereof, and the distance is increased one more time toward the lower end portions thereof.

In the first embodiment, a throat portion 44A-1 is formed at a location where the distance between the contact pieces 44A becomes a minimum. The distance between the contact pieces 44A at the throat portion 44A-1 is smaller than the plate thickness of the contact portion 11A of the first terminal 10. Accordingly, the contact pieces 44A sandwich the contact portion 11A at the throat portion 44A-1, so that the contact pieces 44A elastically contact with the contact portion 11A.

As shown in FIGS. 1(A)-1(B) and 2(A)-2(B), the second terminal 40 having the configuration described above is tightly fitted into the terminal groove portion 55 of the second housing 50 from above. Please note that, in FIGS.

4(A)-4(B) and 5, the second connector 2 is illustrated in the state inverted in the vertical direction from that shown in FIGS. 1(A)-1(B) and 2(A)-2(B). Accordingly, in FIGS. 4(A)-4(B) and 5, the second terminal 40 is tightly fitted into the terminal groove portion 55 of the second housing 50 from below.

As described above, the second terminal 40 is tightly fitted into the terminal groove portion 55 of the second housing 50 from above in FIGS. 1(A)-1(B) and 2(A)-2(B). As shown in FIG. 2(A), a rectangular cylindrical hole portion 54A is formed in the central wall portion 54 to penetrate there through in the vertical direction. The rectangular cylindrical hole portion 54A is formed to have an inner circumferential shape corresponding to an outer circumferential shape of the intermediate base portion 43 having the U character sectional shape. Accordingly, the intermediate base portion 43 is capable of passing through the rectangular cylindrical hole portion 54A.

In the first embodiment, a grove portion 55A is formed in inner wall surfaces of the rectangular cylindrical hole portion 54A and the upper recessed portion 53A. The grove portion 55A is formed to have a depth corresponding to the plate thickness of the held portion 41, so that the grove portion 55A accommodates the contact portion 44 formed in the flat band shape and situated at the inner wall surface of the upper recessed portion 53A after the intermediate base portion 43 having the U character sectional shape passes through the rectangular cylindrical hole portion 54A of the central wall portion 54. When the held portion 41 is fitted into the groove portion 55A, the engaging protruding portion 41A of the held portion 41 bites into the inner surface of the groove portion 55A. Accordingly, it is possible to hold the second terminal 40 with the second housing 50 and prevent the second terminal 40 from coming off.

In the first embodiment, a grove portion 55B is formed in an inner wall surface of the lower recessed portion 53B below the central wall portion 54 (above the central wall portion 54 in FIG. 4(B)). The grove portion 55B accommodates the intermediate base portion 43 and the contact portion 44 when the second terminal 40 is tightly fitted into a specific location. The grove portion 55B is formed to have a groove bottom surface for contacting with or being away from the bottom surface portion 43A of the intermediate base portion 43, and a grove side surface for being away from the side surface portion 43B of the intermediate base portion 43. Further, the grove portion 55B is formed to have a space so that the contact pieces 44A of the contact portion 44 are capable of elastically deforming in the space.

A using operation of the electrical connector for the electrical circuit board will be explained next with reference to FIGS. 1(A)-1(B), 2(A)-2(B), 6(A)-7(B), and 7(A)-7(B).

FIGS. 6(A) and 6(B) are sectional views showing the connector assembled member in a state that the second regulating portion regulates the movable housing 26 from moving in the connector fitting direction according to the first embodiment of the present invention. More specifically, FIG. 6(A) is a sectional view showing the connector assembled member at a position where the terminal is located and FIG. 6(B) is a sectional view showing the connector assembled member at a position where the second regulating member is located.

FIGS. 7(A) and 7(B) are sectional views showing the connector assembled member in a state that the first regulating portion regulates the movable housing 26 from moving in the connector fitting direction according to the first embodiment of the present invention. More specifically, FIG. 7(A) is a sectional view showing the connector assembled member at a position where the terminal is located and FIG. 7(B) is a sectional view showing the connector assembled member at a position where the first regulating member is located.

First, the first connector 1 and the second connector 2 are fixed to the corresponding electrical circuit boards P1 and P2 with solder (refer to FIGS. 6(A)-6(B) and 7(A)-7(B)). More specifically, the first connector 1 is fixed to the corresponding electrical circuit board P1 through the connecting portion 13 of the first terminal 10 and the attachment metal member 30, and the second connector 2 is fixed to the corresponding electrical circuit board P2 through the connecting portion 42 of the second terminal 40 and the attachment metal member 60. It should be noted that although the electrical circuit board is not shown in FIGS. 1(A)-1(B) and 2(A)-2(B), the first connector 1 is attached to the electrical circuit board P1 at the lower surface thereof, and the second connector 2 is attached to the electrical circuit board P2 at the upper surface thereof. Further, it should be noted that the electrical circuit boards P1 and P2 are illustrated in FIGS. 6(A)-6(B) and 7(A)-7(B) with a projected line in a state that the electrical circuit boards P1 and P2 are deformed due to a vibration. When the electrical circuit boards P1 and P2 do not receive a vibration in a normal state, the electrical circuit boards P1 and P2 are in a plate shape having flat plate surfaces.

As shown in FIGS. 1(A) and 2(A), the second connector 2 attached to the electrical circuit board P2 at the upper surface thereof is placed at an upper position above the first connector 1 in a posture that the fitting block portion 52 of the second connector 2 faces downwardly. In the next step, the second connector 2 is lower while maintaining the same posture. As a result, the fitting block portion 52 is inserted into the receiving recessed portion 27 of the movable housing 26 of the first connector 1, so that the fitting block portion 52 is fitted into the movable housing 26 (also referred to FIGS. 1(B) and 2(B)).

When the second connector 2 is connected to the first connector 1, the contact portion 44 of the second terminal 40 of the second connector 2 sandwiches the contact portion 11A of the first terminal 10 of the first connector 1 as the contact portion 44 is formed of the contact pieces 44A with the finger shape. Accordingly, the contact portion 44 elastically contacts with the contact portion 11A with the specific holding force.

As described above, in the first embodiment, the contact portion 44 of the second terminal 40 includes the throat portion 44A-1 at the lower end portions of the contact pieces 44A with the finger shape. Accordingly, when the contact portion 11A with the flat band shape of the first terminal 10 is smoothly inserted into the throat portion 44A-1, the throat portion 44A-1 sandwiches the contact portion 11A of the first terminal 10 with an elastic force, so that the second terminal 40 is electrically connected to the first terminal 10.

Through the process described above, the first connector 1 is connected to the second connector 2. As a result, the electrical circuit board P1 attached to the first connector 1 is electrically connected to the electrical circuit board P2 attached to the second connector 2 through the first terminals 10 and the second terminals 40.

In the first embodiment, when the first connector 1 is started to connect to the second connector 2 (in the middle of the connecting operation), the contact portion 44 of the second terminal 40 sandwiches the contact portion 11A of the first terminal 10 with the elastic force (also referred to as a pressing sandwiching state). Further, when the first connector 1 is completely connected to the second connector 2, the pressing sandwiching state is maintained. As described above, within the elastic deformation range of the elastic portion 14 of the first terminal 10 in the vertical direction, the maximum spring force of the elastic portion 14 becomes smaller than the holding force generated in the pressing sandwiching state.

Accordingly, in the connector connection process, when the contact portion 11A of the movable side column portion 11 of the first terminal 10 is sandwiched with the contact portion 44 of the second terminal 40 with the holding force, the movable side column portion 11 of the first terminal 10 is moved downwardly together with the second terminal 40 while maintaining the contact position (the sandwiched position) relative to the contact portion 44, that is, without sliding the contact portion 11A against the contact portion 44. At this moment, the elastic portion 14 is elastically deformed downwardly, so that the movable side column portion 11 can be moved downwardly. Further, the movable housing 26 tightly holding the movable side column portion 11 is also moved downwardly together with the movable side column portion 11.

In the first embodiment, in the connector connection process, the movable housing 26 is moved downwardly until the regulated portion 29C of the movable housing 26 abuts against the regulating piece 33 of the attachment metal member 30. At this moment, the elastic deformation amount of the elastic portion 14 in the downward direction becomes the maximum amount within the elastic deformation range. Accordingly, the elastic portion 14 is not able to deform downwardly to further extent. As a result, when the second connector 2 is pushed down further from above after the regulated portion 29C of the movable housing 26 abuts against the regulating piece 33 of the attachment metal member 30, only the contact portion 44 of the second terminal 40 is moved downwardly without moving the movable side column portion 11, that is, the contact portion 11A. Accordingly, the contact portion 44 is slid against the contact portion 11A.

Further, in the first embodiment, when the first connector 1 is completely connected to the second connector 2 in the connector connection process, the electrical circuit boards P1 and P2 abut against a spacer (not shown) for securing a specific distance between the electrical circuit boards P1 and P2. In other words, at this moment, the first connector 1 and the second connector 2 are in the connector connected state. In the connector connected state, the regulated portion 29C of the movable housing 26 is maintained to abut against the regulating piece 33 of the attachment metal member 30, and the elastic portion 14 is maintained to deform downwardly with the maximum deformation amount.

Further, as shown in FIG. 1(B), in the connector connected state, there is a specific space in the vertical direction between the regulated protruding portion 26C of the movable housing 26 and the regulating portion 22C of the fixed housing 21. Further, in the connector connected state, the lower end portion of the fitting block portion 52 of the second connector 2 does not abut against the bottom surface of the receiving recessed portion 27 of the first connector 1, so that a specific space is created between the lower end portion of the fitting block portion 52 and the bottom surface of the receiving recessed portion 27.

In the first embodiment, the elastic portion 14 of the first terminal 10 is configured such that the elastic portion 14 is capable of elastically deforming not only in the vertical direction but also the connector longitudinal direction and the connector width direction. Accordingly, in the connector connection process and the connector connected state, even when the second connector 2 is shifted from a standard position or a standard posture in the vertical direction, the connector connection process, or the connector connected state, the elastic portion 14 is capable of absorbing the shift of the second connector 2.

In the first embodiment, in the connector connected state, when the connector assembled member receives a vibration in the connector pulling out direction (the vertical direction), the elastic portion 14 of the first terminal 10 is elastically deformed in the vertical direction (described later), so that the connector assembled member is capable of flowing the vibration. Accordingly, it is possible to maintain the contact portion 11A of the first terminal 10 to contact with the contact portion 44 of the second terminal 40 without sliding against each other.

An operation of the connector assembled member when the connector assembled member receives a vibration externally in the vertical direction will be explained next.

In the first embodiment, when the connector assembled member receives a vibration externally in the vertical direction, the electrical circuit board P1 on which the first connector 1 is mounted and the electrical circuit board P2 on which the second connector 2 is mounted are deformed in a double cantilever state such that the electrical circuit board P1 is moved closer to the electrical circuit board P2 (referred to as an approaching movement, referred to FIGS. 6(A)-6(B)). Further, when the connector assembled member receives a vibration externally in the vertical direction, the electrical circuit board P1 and the electrical circuit board P2 are deformed in the double cantilever state such that the electrical circuit board P1 is moved away from the electrical circuit board P2 (referred to as a separating movement, referred to FIGS. 7(A)-7(B)). It should be noted that the approaching movement and the separating movement are alternately repeated.

In the first embodiment, when the electrical circuit board P1 and the electrical circuit board P2 are moved in the approaching movement and the separating movement, the electrical circuit board P1 and the electrical circuit board P2 are deformed repeatedly with a specific magnitude. It should be noted that the specific magnitude is dependent on a magnitude of the vibration. Further, even when the connector assembled member receives an instant vibration, the electrical circuit board P1 and the electrical circuit board P2 may be deformed.

In the first embodiment, when the connector assembled member receives a vibration externally, the contact portion 11A of the first terminal 10 is slid against the contact portion 44 of the second terminal 40 in the first cycle of the approaching movement. Accordingly, the contact portion 11A of the first terminal 10 is slightly shifted from the initial contact position with the contact portion 44 of the second terminal 40 right after the connector connecting process (before the connector assembled member receives the vibration). Afterward, even when the vibration is continued, the contact portion 11A of the first terminal 10 is not shifted (described later).

In the following description, the operation of the connector assembled member will be explained in the first cycle of the approaching movement, the first cycle of the separating movement, and the second cycle of the approaching movement, in this order. It should be noted that the operation of the connector assembled member after the second cycle of the separating movement is identical to that in the first cycle of the approaching movement and the first cycle of the separating movement, and an explanation thereof is omitted.

In the first cycle of the approaching movement, the vibration is started, and the electrical circuit board P1 and the electrical circuit board P2 are deformed to approach each other. In other words, the electrical circuit board P1 on which the first connector 1 is mounted is deformed upwardly, and the electrical circuit board P2 on which the second connector 2 is mounted is deformed downwardly.

As shown in FIGS. 6(A) and 6(B), in the first cycle of the approaching movement, the fixed housing 21 of the first connector 1 is moved upwardly together with the electrical circuit board P1, and the second connector 2 is moved downwardly together with the electrical circuit board P2.

As described above, in the first embodiment, it is configured such that the holding force between the contact portion 44 of the second terminal 40 and the contact portion 11A of the first terminal 10 is greater than the spring force of the elastic portion 14 of the first terminal 10. Accordingly, when the elastic portion 14 of the first terminal 10 is deformed downwardly, the second terminal 40 is moved downwardly together with the movable side column portion 11 while the second terminal 40 maintains to contact with the movable side column portion 11 of the first terminal 10 at the contact position.

As shown in FIG. 6(B), the regulated portion 29C of the movable housing 26 of the first connector 1 abuts against the regulating piece 33 of the attachment metal member 30. Accordingly, the movable housing 26 along with the movable side column portion 11 is restricted from moving downwardly. As a result, the movable side column portion 11 of the first terminal 10 does not move downwardly, but is moved upwardly together with the fixed housing 21. Further, the second terminal 40 is moved downwardly. Accordingly, the contact portion 44 of the second terminal 40 is slid against the contact portion 11A of the first terminal 10, so that the contact position between the contact portion 11A and the contact portion 44 is shifted downwardly from the one before the vibration is started.

It should be noted that the contact portion 44 of the second terminal 40 stops sliding against the contact portion 11A of the first terminal 10 when the electrical circuit board P1 approaches the electrical circuit board P2 at the closest position. At this moment, as shown in FIG. 6(A), the elastic portion 14 of the first terminal 10 is maintained to elastically deform downwardly to the maximum extent. Further, as shown in FIG. 6(B), the regulated portion 29C of the fixed housing 21 is maintained to abut against the regulating piece 33 of the attachment metal member 30.

After the first cycle of the approaching movement, the electrical circuit board P1 and the electrical circuit board P2 are deformed to separate from each other. In other words, the electrical circuit board P1 on which the first connector 1 is mounted is deformed downwardly, and the electrical circuit board P2 on which the second connector 2 is mounted is deformed upwardly.

As shown in FIGS. 7(A) and 7(B), in the first cycle of the separating movement, the fixed housing 21 of the first connector 1 is moved downwardly together with the electrical circuit board P1, and the second connector 2 is moved upwardly together with the electrical circuit board P2.

As described above, in the first embodiment, it is configured such that the holding force between the contact portion 44 of the second terminal 40 and the contact portion 11A of the first terminal 10 is greater than the spring force of the elastic portion 14 of the first terminal 10. Accordingly, when the second connector 2 and the second terminal 40 are moved upwardly, the elastic portion 14 of the first terminal 10 is deformed upwardly, the movable side column portion 11 of the first terminal 10 and the movable housing 26 are moved upwardly as well as the second terminal 40 is moved upwardly.

It should be noted that the contact portion 44 of the second terminal 40 is not lid against the contact portion 11A of the first terminal 10 just before the regulated portion 29C of the movable housing 26 of the first connector 1 abuts against the regulating piece 33 of the attachment metal member 30. Accordingly, the contact position between the contact portion 44 of the second terminal 40 and the contact portion 11A of the first terminal 10 is maintained as just after the first cycle of the approaching movement is completed.

As shown in FIG. 7(B), when the upper surface of the regulated protruding portion 26C of the movable housing 26 abuts against the regulating portion 22C of the fixed housing 21, the movable housing 26 of the first connector 1 is restricted from further moving upwardly. At this moment, the elastic portion 14 of the first terminal 10 is maintained to elastically deform upwardly to the maximum extent.

In the second cycle of the approaching movement, the electrical circuit board P1 and the electrical circuit board P2 are deformed to approach each other after the first cycle of the separating movement. Accordingly, when the elastic portion 14 of the first terminal 10 is deformed downwardly, the second terminal 40 is moved downwardly together with the movable side column portion 11. As a result, the elastic portion 14 of the first terminal 10 is changed from the state shown in FIG. 7(A) in which the elastic portion 14 of the first terminal 10 is maintained to elastically deform upwardly to the maximum extent to the state shown in FIG. 6(A) in which the elastic portion 14 of the first terminal 10 is maintained to elastically deform downwardly to the maximum extent.

It should be noted that, after the first cycle of the approaching movement is completed, the contact portion 44 of the second terminal 40 is shifted downwardly from the contact portion 11A of the first terminal 10 from the position before the vibration is started. Accordingly, in the second cycle of the approaching movement, the contact portion 44 of the second terminal 40 is not slid against the contact portion 11A of the first terminal 10. As a result, the contact position between the contact portion 44 of the second terminal 40 and the contact portion 11A of the first terminal 10 is maintained.

During a period of time when the connector assembled member continues to receive a vibration externally, after the second cycle of the approaching movement, the separating movement and the approaching movement are repeated. As described above, the operation of the connector assembled member after the second cycle of the separating movement is identical to that in the first cycle of the approaching movement and the first cycle of the separating movement. That is, the contact portion 44 of the second terminal 40 is no longer slid against the contact portion 11A of the first terminal 10, and the contact position between the contact portion 44 of the second terminal 40 and the contact portion 11A of the first terminal 10 is maintained. Accordingly, in the first embodiment, the contact position between the contact portion 44 of the second terminal 40 and the contact portion 11A of the first terminal 10 is not moved to a large extent. As a result, it is possible to minimize wear between the contact portion 44 of the second terminal 40 and the contact portion 11A of the first terminal 10 due to friction at the contact position.

As described above, in the first embodiment, when the connector assembled member receives a vibration externally, the electrical circuit board P1 and the electrical circuit board P2 are repeatedly deformed in the order of the approaching movement and the separating movement. The present invention is applicable to a case in which the electrical circuit board P1 and the electrical circuit board P2 are repeatedly deformed in the order of the separating movement and the approaching movement. That is, after the first cycle of the approaching movement, the contact portion 44 of the second terminal 40 is no longer slid against the contact portion 11A of the first terminal 10, and the contact position between the contact portion 44 of the second terminal 40 and the contact portion 11A of the first terminal 10 is maintained at the constant position.

Second Embodiment

A second embodiment of the present invention will be explained next. As described above, in the first embodiment, the first regulating portion for defining the lower limit of the elastic deformation range of the elastic portion 14 is formed of the regulated portion 29C formed on the lower surface at the end portion of the bottom wall portion 29 of the movable housing 26 in the connector longitudinal direction and the regulating piece 33 of the attachment metal member 30. Different from the configuration in the first embodiment, in the second embodiment, the first regulating portion is formed of a regulated portion extending over an entire portion of the lower surface at the end portion of the bottom wall portion 29 of the movable housing 26 in the connector longitudinal direction and a regulating portion formed on an upper surface of the electrical circuit board.

In the following description, differences in the configuration from those in the first embodiment will be mainly explained, and explanations of components similar to those in the first embodiment are omitted.

Figure 8:
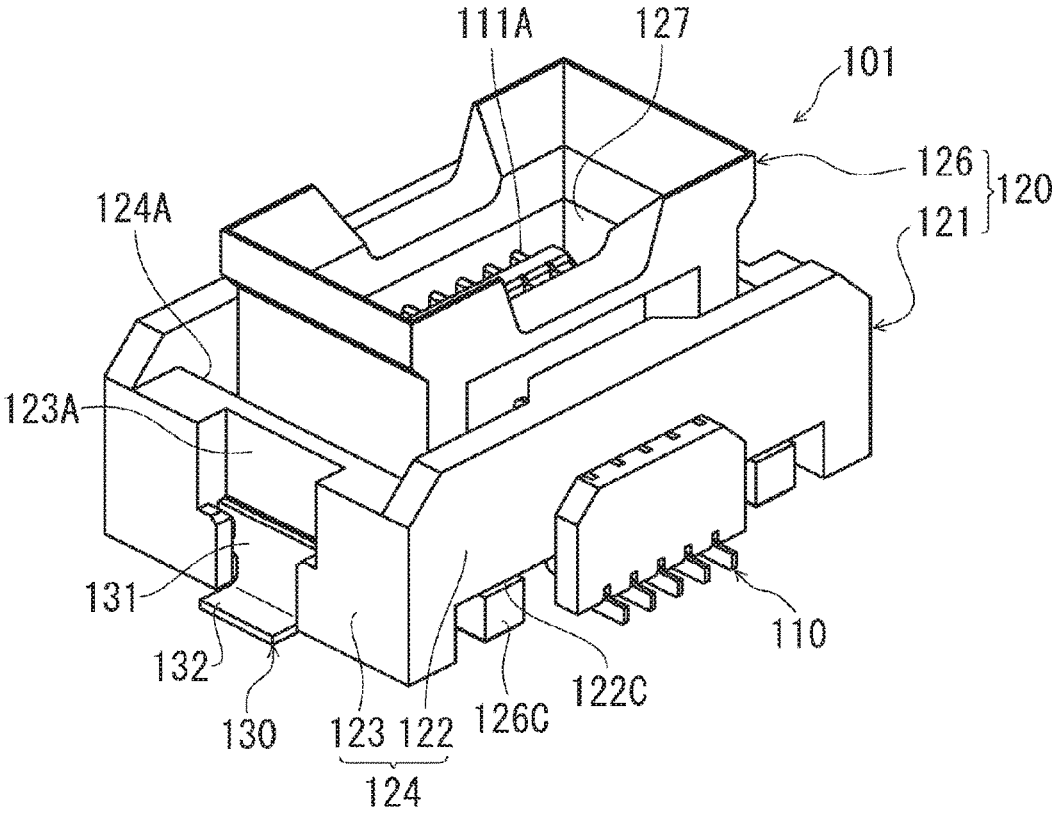
FIG. 8 is a perspective view showing having a plug side connector of a connector assembled member according to a second embodiment of the present invention.

FIG. 8 is a perspective view showing having a plug side connector 101 of a connector assembled member according to the second embodiment of the present invention. It should be noted that components in FIG. 8 corresponding to those in the first embodiment are designated with numeral references increased by one hundred from the numeral references of those in the first embodiment.

As shown in FIG. 8, the first terminal 101 includes an attachment metal member 130. Different from the attachment metal member 30 in the first embodiment, the attachment metal member 130 does not have the regulating piece 33 extending in the connector longitudinal direction. The attachment metal member 130 includes a held portion 131 and an attachment piece 132. The attachment piece 132 is arranged to extend outwardly from a lower edge of the held portion 131 over an entire range of the held portion 131 in the connector width direction, so that the attachment metal member 130 is fixed to the electrical circuit board with solder.

In the second embodiment, the first terminal 101 includes first terminals 110 and a first housing 120. It should be noted that the first terminals 110 and the first housing 120 are formed in shapes similar to those of the first terminal 10 and the first housing 20 in the first embodiment.

In the second embodiment, the first terminal 101 is mounted on a mounting surface (an upper surface) of the electrical circuit board (not shown), and the regulating portion is formed on the mounting surface (the upper surface) of the electrical circuit board. Further, the regulated portion is formed on the bottom surface of a movable housing 126, so that the second regulating portion is formed of the regulated portion and the regulating portion.

More specifically, the regulated portion corresponds to a portion of the movable housing 126 protruding from the lower surface of the bottom wall portion of the movable housing 126 at a central portion thereof in the connector width direction over an entire portion thereof in the connector longitudinal direction (for example, a portion corresponding to the lower protruding portion 29D shown in FIG. 3(B)). The regulating portion corresponds to a portion of the upper surface of the electrical circuit board facing the regulated portion described above. It is configured such that the regulating portion abuts against the regulated portion, so that the second regulating portion restricts the movable housing 126 from moving downwardly within a specific distance.

In the second embodiment, the regulated portion is arranged to extend over an entire portion of the bottom wall portion of the movable housing 126 in the connector longitudinal direction. Alternatively, the regulated portion may be arranged to extend over a partial portion of the bottom wall portion of the movable housing 126 in the connector longitudinal direction. Further, in the second embodiment, the regulated portion is arranged to protrude from the lower surface of the bottom wall portion of the movable housing 126. Alternatively, the regulated portion may be the lower surface (the flat surface) of the bottom wall portion of the movable housing 126 without protruding from the lower surface of the bottom wall portion of the movable housing 126.

As described above, in the first embodiment and the second embodiment, the regulating portion and the regulated portion of the first regulating portion are disposed on the fixed housing and the movable housing, respectively. Alternatively, the regulating portion may be disposed on a component (referred to as a first fixed side member) attached to the fixed housing, and the regulated portion may be disposed on a component (referred to as a first movable side member) attached to the movable housing. The first fixed side member and the first movable side member may be formed of a metal member and the like.

As described above, in the first embodiment and the second embodiment, the regulating portion of the second regulating portion is disposed on the attachment metal member or the electrical circuit board as a second fixed side member attached to the fixed housing. Alternatively, the regulating portion of the second regulating portion may be formed at a portion of the fixed housing. More specifically, the regulating portion of the second regulating portion may be formed as a portion of the fixed housing extending right below the movable housing. In this case, the bottom surface of the movable housing functions as the regulated portion when the bottom surface of the movable housing abuts against the regulating portion from above.

Further, in the first embodiment and the second embodiment, the regulated portion of the second regulating portion is disposed on the movable housing. Alternatively, the regulated portion of the second regulating portion may be disposed on a component (referred to as a second movable side member) attached to the movable housing. The second movable side member may be formed of a metal member and the like.

As described above, in the first embodiment and the second embodiment, both the first regulating portion and the second regulating portion are disposed. Alternatively, just one of the first regulating portion and the second regulating portion may be disposed.

As described above, in the first embodiment and the second embodiment, the first connector and the second connector are connected in the direction perpendicular to the electrical circuit boards while the electrical circuit boards on which the first connector and the second connector are mounted are maintained in the state parallel to each other. It should be noted that the present invention is applicable to a right angle connection. In the right angle connection, the first connector and the second connector may be connected while the electrical circuit boards are in a state perpendicular to each other. Further, in the right angle connection, the first connector and the second connector may be connected in a direction in parallel to the electrical circuit boards while the electrical circuit boards are maintained in the state perpendicular to each other.

The disclosure of Japanese Patent Application No. 2016-102105 filed on May 23, 2016, is incorporated in the application by reference.

While the invention has been explained with reference to the specific embodiments of the invention, the explanation is illustrative and the invention is limited only by the appended claims.

What is claimed is:

1. A connecting structure, comprising:

an electrical connector, wherein said electrical connector includes:

a housing;

a terminal held with the housing; and a regulating portion, said housing includes a fixed housing to be fixed to an electrical circuit board and a movable housing configured to be movable relative to the fixed housing, said movable housing is configured to accommodate a mating connecting member, said terminal includes a connecting portion to be connected to the electrical circuit board on one end portion thereof and a contact portion to be contacted with the mating connecting member on the other end portion thereof, said terminal further includes a fixed side held portion held with the fixed housing, a movable side held portion held with the movable housing, and an elastic portion connecting the fixed side held portion and the movable side held portion, and configured to be capable of elastically deforming, said regulating portion is disposed on the fixed housing and the movable housing for regulating the elastic portion from elastically deforming within a specific elastic deformation range in a direction that the electrical connector is fitted, and said elastic portion is configured to have a specific spring force when the elastic portion is elastically deformed to a maximum elastic deformation amount within the specific elastic deformation range so that the spring force is smaller than a holding force between the contact portion of the terminal and the mating connecting member in a direction that the electrical connector is pulled out when the electrical connector is connected to the mating connecting member.

2. The connecting structure according to claim 1, wherein said regulating portion includes a first regulating portion and a second regulating portion, said first regulating portion is configured to set one limit of the specific elastic deformation range, said second regulating portion is configured to set the other limit of the specific elastic deformation range.

3. The connecting structure according to claim 2, wherein said first regulating portion includes a portion of the fixed housing or a first fixed side member attached to the fixed housing, and a portion of the movable housing or a first movable side member attached to the movable housing, and said first regulating portion is configured to set the one limit of the specific elastic deformation range when the portion of the fixed housing or the first fixed side member abuts against the portion of the movable housing or the first movable side member when the elastic portion elastically deforms in the direction that the electrical connector is pulled out.

4. The connecting structure according to claim 2, wherein said second regulating portion includes a portion of the fixed housing or a second fixed side member attached to the fixed housing, and a portion of the movable housing or a second movable side member attached to the movable housing, and said second regulating portion is configured to set the other limit of the specific elastic deformation range when the portion of the fixed housing or the second fixed side member abuts against the portion of the movable housing or the second movable side member when the elastic portion elastically deforms in the direction that the electrical connector is pulled out.

* * * * *